United States Patent [19]

Dellian et al.

[11] B 4,000,969

[45] Jan. 4, 1977

[54] DYEING AND PRINTING SYNTHETIC HYDROPHOBIC FIBERS WITH A CARRIER COMPRISING PHENYL CYCLOHEXANE AND DERIVATIVES

[75] Inventors: Kurt A. Dellian; Jayanti V. Isharani, both of Greensboro, N.C.

[73] Assignee: Ciba-Geigy Corporation, Ardsley, N.Y.

[22] Filed: Dec. 27, 1974

[21] Appl. No.: 537,058

[44] Published under the second Trial Voluntary Protest Program on March 23, 1976 as document No. B 537,058.

[52] U.S. Cl. ..... 8/173; 8/82; 8/174; 8/175; 8/177 R; 8/178 R; 8/179

[51] Int. Cl.[2] ..... D06P 5/04; D06P 1/673

[58] Field of Search ..... 8/173, 174, 175, 93, 8/82

[56] References Cited

FOREIGN PATENTS OR APPLICATIONS 368,137 5/1963 Switzerland

*Primary Examiner*—Donald Levy
*Assistant Examiner*—A. L. Clingman
*Attorney, Agent, or Firm*—Edward McC. Roberts; Joseph G. Kolodny; Prabodh I. Almaula

[57] ABSTRACT

This invention relates to a dye carrier and to dyeing and printing processes which utilize said dye carrier. The dye carrier and the processes are particularly suitable for use in the dyeing and printing of synthetic organic fibers, notably the hydrophobic synthetic organic fibers. The carrier comprises phenyl cyclohexane or a derivative thereof having the general formula:

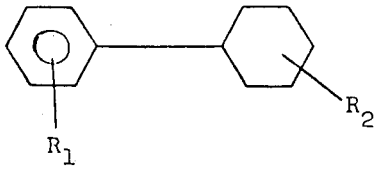

where $R_1$ is hydrogen or lower alkyl and $R_2$ is hydrogen, hydroxyl, lower alkyl, halogen or lower alkoxy.

9 Claims, No Drawings

DYEING AND PRINTING SYNTHETIC HYDROPHOBIC FIBERS WITH A CARRIER COMPRISING PHENYL CYCLOHEXANE AND DERIVATIVES

BACKGROUND OF THE INVENTION

Synthetic fibers have achieved widespread consumer acceptance. Typical examples of such synthetics include the polyester fibers such as Dacron, Kodel, Vycron, Terylene, Fortrel, Encron and Trevira; the acrylic fibers such as Acrilan, Orlon and Creslan; cellulose acetate such as Arnel and Tricel; polyamide such as nylon; polyolefins such as polypropylene. In addition there can be employed the modifications of the above hydrophobic textiles such as acid modified polyester, deep dyeable polyester, cationic dyeable polyamide, modacrylic and such newer materials as Qiana.

These hydrophobic materials usually cannot be dyed by ordinary dyeing procedures as have been previously used for dyeing such fibers as cotton, wool, silk, regenerated cellulose and the like. When such conventional dyeing procedures are used with hydrophobic textiles, the dye usually does not penetrate the textile and either no dyeing is obtained or a very poor quality dyeing results. If dyeing does not result, the color is usually not fast and tends to wash out of the textile. Due to these dyeing difficulties, the dyeing of hydrophobic synthetic fibers is generally effected by other methods such as for example by the use of a dye carrier in the presence of a swelling agent. These components tend to open the pores of the hydrophobic fibrous material and permit the dye to enter and remain there in a colorfast manner.

As a result of the problems incurred in dyeing and printing synthetic fibers a tremendous amount of work was commenced to discover appropriate compounds and compositions that have the property of increasing the rate of dyeing of synthetic hydrophobic fibers when added to the dyebath. These compounds and compositions are generally called carriers and in the past ten or so years extensive research has been carried out relative to these carriers.

In addition to having a swelling action, any useful carrier must have a high efficiency, should have no effect or enhance the fastness properties of the dyed fibers and should not degrade or discolor the fiber in question. The carrier should be readily removed from the fiber after dyeing, and it should be stable under the conditions of the dyebath. In addition to these properties the carrier should be compatible with dyes employed, should leave no residual odor in the finished textile and should not be toxic.

carrier composition which contains a phenyl cyclohexane compound of the following formula:

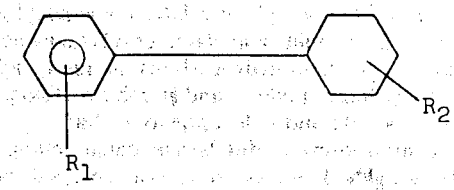

wherein $R_1$ is hydrogen or lower alkyl and $R_2$ is hydrogen, hydroxyl, lower alkyl, halogen or lower alkoxy.

Of particular interest are compounds of the above formula where $R_1$ and $R_2$ are both hydrogen; where $R_1$ is hydrogen and $R_2$ is chloro; and where one of $R_1$ and $R_2$ is hydrogen and the other is methyl. Where $R_1$ or $R_2$ is lower alkyl, of particular interest are methyl and ethyl. Where $R_2$ is lower alkoxy, of particular interest are methoxy and ethoxy. Where $R_2$ is halogen, of particular interest are chlorine and bromine.

In one aspect, the invention relates to a composition comprising a phenyl cyclohexane compound as described above and an emulsifying agent. In one embodiment of this aspect, the composition comprises a conventional carrier, a phenyl cyclohexane compound as described above and an emulsifying agent. In yet another embodiment the carrier composition comprises from 30 to 97% of a phenyl cyclohexane as described above, up to 60% of a conventional carrier, from 3 to 60% of an emulsifier and up to 50% of a solvent. In another aspect, the invention involved an improvement in a process for coloring a hydrophobic textile fiber with a dyestuff using a carrier, the imporvement comprising the presence of a phenyl cyclohexane compound as described above. The phenyl cyclohexane derivatives described above for use in accordance with this invention can come from any conventional source provided the level of phenyl cyclohexane and derivatives thereof in the final product is adjusted to achieve the desired results and no objectionable contaminants are present.

The phenyl cyclohexane compound useful herein can be obtained, in one mode of synthesis, by the Friedel-Crafts alkylation of benzene with cyclohexane or cyclohexanol. The reactions are described at page 576, Fieser and Fieser, Organic Chemistry, Second Edition, Copyright 1950, D.C. Heath and Co. The reactions are summarized below:

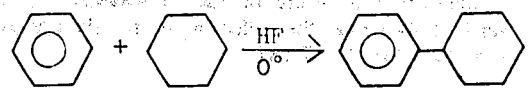

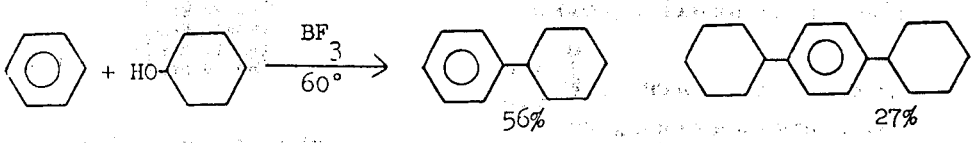

DESCRIPTION OF THE INVENTION

It has now been found that the dyeing and printing of synthetic hydrophobic fibers is facilitated by a novel The phenyl cyclohexane compound described herein can be used alone or in conjunction with other carriers and assistants known to the prior art. Such known carriers and assistants include biphenyl, lower alkyl biphenyls such as methyl biphenyl, naphthalene, lower alkyl naphthalenes such as methyl naphthalene, lower alkyl benzoate esters such as butyl benzoate, phenyl phenol, phenyl salicylate, aralkyl salicylates such as benzyl salicylate and phenethyl salicylate, lower alkyl salicylates such as methyl salicylate, ethyl salicylate and butyl salicylate, halo-hydrocarbons such as dichlorobenzene, trichloroethylene and perchloroethylene, diphenyl carbonate and chlorophenoxyethanol.

The compositions useful herein can contain up to 60% by weight of one or more conventional carriers and/or assistants as described above, but preferably contain no more that about 40% of the conventional carrier.

The compositions of this invention can also contain from 3 to about 60% of an emulsifier, which can be a nonionic or anionic wetting agent or a combination thereof.

Typical anionic surfactants which are useful include the salts of long-chain carboxylic, sulfonic and sulfuric acid esters, alkylated aromatic sulfonic acids and salts of long-chain amines. Thus there are the alkyl-aryl sulfonates, the alkyl sulfonates, the sulfonated fatty acid amides, and the sulfonated monoglycerides. The organic base, ammonium, sodium and potassium salts of the anionic type surfactants can be used.

Thus, for example, surfactants such as $C_1$ to $C_{18}$—alkyl — $[C_6H_4]$ $[OCH_2CH_2]_{4-40}$ — OH (Igepal series — GAF)

or $C_1$ to $C_{18}$—alkyl — $[C_6H_4]$ $[OCH_2CH_2]_{1-10}$ — $OSO_2Na$ (Igepon series — GAF)

may be used.

The nonionic type surfactants useful herein can be described as those surfactants which do not ionize in solution but owe their water solubility to unionized polar groups such as hydroxy or other linkages. The main types of surfactants falling within this category are the polyoxyethylene ethers of the higher fatty alcohols and alkyl phenols; the polyethylene glycols of fatty acids; fatty alkylol amide condensation products; polymers of ethylene and propylene oxides; compounds formed by the addition of propylene oxide to ethylene diamide, followed by the addition of ethylene oxide; fatty acid ethylene oxide condensation products; condensation products of ethylene oxide and a fatty acid ester of a polyhydric alcohol; and the products prepared by heating together a higher fatty acid with a diethamol amine.

Illustrative of some of the emulsifying agents described above are the following materials, described in U.S. Pat. No. 3,787,181;

$C_8$ to $C_{24}$—COOM  $C_8$ to $C_{24}OSO_2OM$
$C_{12}$ to $C_{18}$—$SO_3M$  $C_3$ to $C_{18}$—Ar—$SO_3M$
$C_1$ to $C_{18}$—$(C_6H_4)$—$(OCH_2CH_2)_{1-10}$—$OSO_2M$ $C_1$ to $C_{18}$—$(CH_6H_4)$—$(OCH_2CH_2)_{1-10}$—$P(=O)(OM)_2$ $C_1$ to $C_{18}$—$(C_6H_4)$—$(OCH_2CH_2)_{4-40}$—OH
$C_8$ to $C_{24}$—$(OCH_2CH_2)_{4-40}$—OH
$C_1$ to $C_{24}$—$(OCH_2CH_2)_{1-4}$—$OSO_3M$ $C_8$ to $C_{24}$—$(OCH_2CH_2)_{1-4}$—O—$P(=O)(OM)_2$ where M is a cation such as sodium, potassium, ammonium or a derivative os ammonia; and Ar is an aromatic nucleus selected from benzene, naphthalene or anthracene.

Representative specific emulsifying agents which can be employed are Turkey red oil, sodium lauryl sulfate, sodium dodecyl benzene sulfonate, triethanolamine salt of lauryl sulfate, ethoxylated nonylphenol, sodium octadecyl, benzene sulfonate, sodium octadecyl sulfate, sodium salt of the oleic acid amide of methyl taurine, and condencation products obtained by condensing polyethyleme glycol with coconut fatty acids and oleic acids, as well as the triethanolamine and ammonium hydroxide salts of oleic, stearic and tallow fatty acids. An example of preferred emulsifying agent is the triethanolamine salt of lauryl sulfate.

There can be added to the compositions of this invention capatable materials which do not effect their basic and novel characteristics. Among such materials are coloring agents, including dyes and pigments, fillers, antioxidants, antistatic agents, stabilizers, anti-foaming agents, and solvents. The quantity of such additives is usually limited to about 50 weight percent of total composition.

As is indicated above, anti-foaming agents can be added to the compositions of this invention. In this connection it should be noted that the compositions in question are particularly advantageous in that they have a very low foaming tendency and so anti-foaming agents are usually not required.

The carrier compositions of this invention can be used in conjunction with disperse, acid, basic and premetallized dyes. Examples of specific dyes that can be used in accordance with this invention are:

| | |
|---|---|
| Basic Yellow 11 | C.I. No. 48055 |
| Basic Yellow 13 | No C.I. No. assigned |
| Basic Yellow 15 | No C.I. No. assigned |
| Basic Yellow 16 | No C.I. No. assigned |
| Basic Blue 4 | C.I. No. 51004 |
| Basic Blue 15 | No C.I. No. assigned |
| Basic Red 16 | No C.I. No. assigned |
| Basic Green 4 | C.I. No. 42000 |
| Acid Yellow 17 | C.I. No. 18965 |
| Acid Yellow 23 | C.I. No. 19140 |
| Acid Yellow 40 | C.I. No. 18950 |
| Acid Yellow 73 | C.I. No. 45350 |
| Acid Red 14 | C.I. No. 14720 |
| Acid Red 35 | C.I. No. 17045 |
| Acid Red 73 | C.I. No. 27290 |
| Acid Red 85 | C.I. No. 22245 |
| Acid Red 88 | C.I. No. 15620 |
| Acid Blue 25 | C.I. No. 62055 |
| Acid Blue 40 | C.I. No. 62125 |
| Acid Blue 45 | C.I. No. 63010 |
| Acid Blue 113 | C.I. No. 26360 |
| Acid Blue 158 | C.I. No. 14880 |
| Acid Green | C.I. No. 61570 |
| Disperse Yellow 23 | C.I. No. 26070 |
| Disperse Yellow 54 | No C.I. No. assigned |
| Disperse Blue 3 | C.I. No. 61505 |
| Disperse Blue 7 | C.I. No. 62500 |
| Disperse Blue 27 | C.I. No. 60767 |
| Disperse Red 55 | No C.I. No. assigned |
| Disperse Red 60 | No C.I. No. assigned |

These dye designations are in accordance with the international Colour Index names as compiled by the American Association of Textile chemists and Colorists, Research Triangle Park, North Carolina and the Society of Dyers and Colourists, Manchester, England Selection of specific dyestuffs and dyestuff mixtures would normally be dependent on the substrate being dyed; selection of any given dye or mixture of dyes to achieve a given effect is considered to be within the reasonable skills of a dyestuff chemist.

There are various procedures for dyeing or printing synthetic hydrophobic textile fibers with a useful dyestuff and the emulsified carrier. One technique for dyeing comprises adding the dyestuffs, such as a disperse dyestuff, and emulsified carrier to the dyebath containing the textile. Another method comprises applying the emulsified carrier prior to the dyeing process. This can be done simultaneously during the prescouring operation. The pretreated material is then rinsed and entered into a fresh dyebath containing only the dyestuff.

If printing is employed it can be done in the usual manner by adding the carrier emulsion to the printing paste and printing the fabric on a roller or screen printing unit. The dye may be fixed by exposing to a steam or heat treatment.

Dye concentrations for use in accordance with this invention can range from about 0.1 to about 10% based on the weight of textile being dyed. It is understood by one skilled in the art that the exact makeup of the dyebath can vary considerably due to such things as the nature of the textile being dyed, the nature of the dye, the operating temperature, the carrier concentration, etc.

The amount of carrier composition to be added to the dyebath can be varied within relatively wide limits and the amount depends primarily upon the dry weight of the hydrophobic synthetic textile being dyed. As a general proporition there can be used from about 1 to about 15% by weight of carrier composition, based on the dry weight of the hydrophobic synthetic textile. Greater amounts of carrier can be used but is less preferred from the standpoint of economy. More generally, about 2 to about 10% of carrier composition will be employed.

The carrier compositions described herein can, in addition to the materials described above, contain up to 50% of one or more solvents. Exemplary organic solvents include the aliphatic and aromatic hydrocarbons such as hexane, n-heptane and benzene, xylene and toluene; halogenated hydrocarbons such as methylene chloride, trichloroethylene, chlorobenzene and perchloroethylene; nitrated aliphatic hydrocarbons such as nitropropane; aliphatic amides such as dimethylformamide; glycols such as ethylene glycol, diethylene glycol, triethylene glycol, polyethylene glycol monoethylether and polyethylene glycol diethylether; diethylcarbonate; dimethylcarbonate; ester solvents such as ethylacetate, propylacetate, butylacetate and beta-ethoxytheyl acetate; aliphatic and cycloaliphatic ketones such as methyl ethyl ketone, methylisobutyl ketone, cyclohexanone, isophorone, mesityloxide and diacetone alcohol; aromatic and aliphatic alcohols, such as methanol, ethanol, and propanol and isopropanol and butanol, t-butanol, secondary butanol, benzyl alcohol, in addition, mixtures of several solvents can be employed, if desired.

The dyeing process may be advantageously run at elevated temperatures, eg. from 90° to 212°F. As an alternative embodiment, dyeing may be run under pressure at temperatures of above 212° to about 300°F, preferably from 220° to 280°F.

The invention is further illustrated by the following examples. All phenylcyclohexane, are by weight unless otherwise disclosed.

EXAMPLE 1

The dyeing carrier is prepared from 90 parts of phenylcyclohexane and 10 parts of oxethylated nonylphenol with 12 mole ethyleneoxide. 8% of this mixture (based on the weight of fabric) is added at 120°F to a dyebath containing a polyester fabric "Dacron" in a ratio of 40:1 and 3% of a dyestuff of the following formula:

Disperse Blue 71

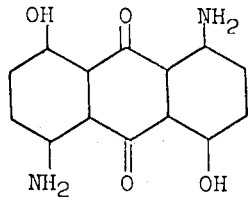

The fabric is then run 15 minutes at 120°F, the temperature raised within 30 minutes to the boil and kept 90 minutes at this temperature. A strong blue shade is obtained with very good light-fastness.

EXAMPLE 2

The same as Example 1, but with 3% of the dyestuff of the following formula:

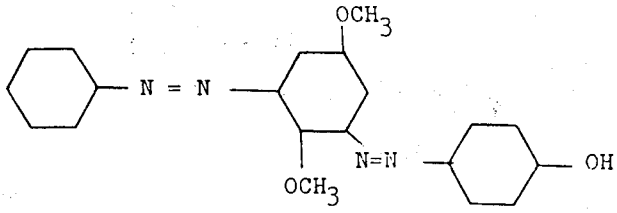

A deep orange shade is obtained with very good fastness properties.

EXAMPLE 3

The same as Example 1, but instead of phenlcyclohexane, monochloro phenylcyclohexane (isomeric mixture) is used. Instead of 8% only 6% of the carrier

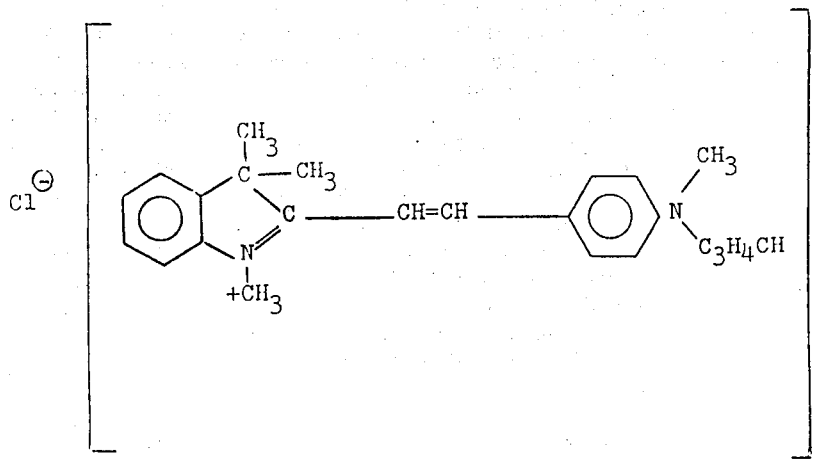

emulsion is used. The results are the same as under Example 1.

EXAMPLE 4

The same as Example 1, but instead of phenylcyclohexane, methylphenyl cyclohexane (isomeric mixture) is used at the same concentration with 3% of the dyestuff of the following formula:

Disperse Orange 21

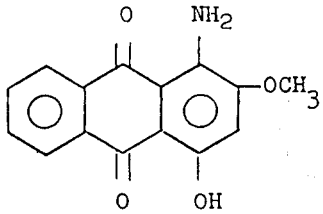

A bright orange shade is obtained.

EXAMPLE 5

A printing paste containing 10% of a carrier emulsion, containing instead of phenylcyclohexane a eutectic mixture of 60 parts phenylcyclohexane and 40 parts biphenyl and 2.5% of a dyestuff of the following formula:

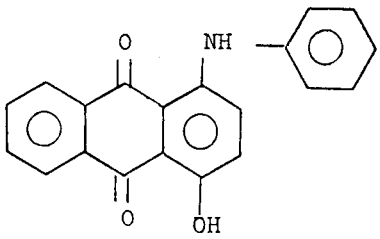

3% alginate thickener, 20% mineral spirit was printed on a polyester "Dacron" cloth and submitted to a 1 minute curing at 350°F. After rinsing and soaping a vivid reddish blue was obtained which could not be obtained with biphenyl alone.

EXAMPLE 6

A fabric of acid modified polyester, trade name "Dacron 64" is dyed according to Example 1, with 1.5% of the dyestuff of the following formula:

A brilliant pink with general good fastness properties was obtained.

Several embodiments of this invention have been illustrated and described herein, but it will be apparent to those with skill in the art that additional modifications may be made without departing from the spirit of the invention and the scope of the appended claims.

EXAMPLE 7

The same as Example 5 but instead of printing a polyester flat good, polyester medium pile carpet was padded on a Kuester padder and submitted to subsequent steaming. A vivid reddish blue carpet pile was obtained.

EXAMPLE 8

The procedure of Example 1 is repeated but instead of phenyl cyclohexane, phenyl cyclohexanol is used with 1-part of the following dyestuff:

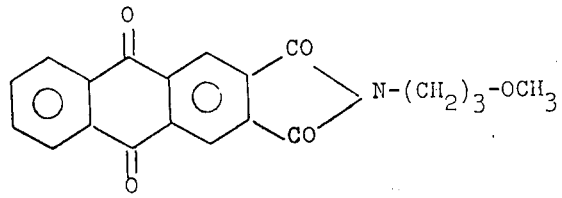

A blue shade of good fastness was obtained.

EXAMPLE 9

The above Example 8 was repeated, but instead of dyeing at 212°F, it was dyed at 250°F, under pressure, for one hour. Again a dark blue shade with good fastness was obtained.

What we claim is:

1. In a process for coloring a textile fiber with a disperse, acid, basic or premetallized dyestuff with the aid of a carrier, the improvement comprising using as a carrier a compound of the general formula:

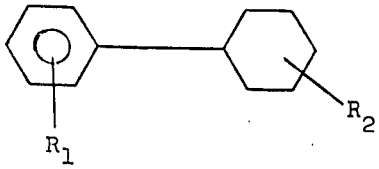

where $R_1$ is hydrogen or lower alkyl; and $R_2$ is hydrogen, lower alkyl, halogen or lower alkoxy.

2. The process according to claim 1, wherein $R_1$ and $R_2$ are hydrogen.

3. The process of claims 1, wherein said textile fiber is polyethylene terephthalate.

4. The process according to claim 1, wherein the dyestuff is a disperse dye.

5. The process according to claim 4, wherein $R_1$ and $R_2$ are hydrogen.

6. A composition comprising a. a compound of the formula

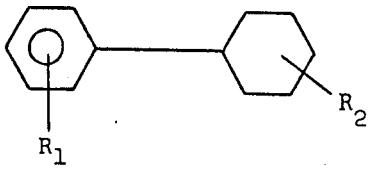

where $R_1$ is hydrogen or lower alkyl; and $R_2$ is hydrogen, lower alkyl, halogen or lower alkoxy, and b. an anionic or nonionic surfactant, or mixture thereof.

7. The composition of claim 6, comprising a. from 30 to 97% of phenycyclohexane, b. up to 60% of a second carrier, c. from 30 to 60% of a surfactant, and d. up to 50 percent of a solvent.

8. The process of claim 1, wherein $R^1$ is hydrogen, methyl or ethyl and $R^2$ is hydrogen, methyl, ethyl, methoxy, ethoxy, chlorine or bromine.

9. The composition of claim 6, wherein $R^1$ is hydrogen, methyl or ethyl and $R^2$ is hydrogen, methyl, ethyl, methoxy, ethoxy, chlorine or bromine.

* * * * *